US008696890B2

(12) United States Patent
Soto et al.

(10) Patent No.: US 8,696,890 B2
(45) Date of Patent: Apr. 15, 2014

(54) DESULFURIZATION PROCESS USING ALKALI METAL REAGENT

(75) Inventors: Jorge L. Soto, Centreville, VA (US); Michael Raterman, Doylestown, PA (US); Daniel P. Leta, Flemington, NJ (US); Walter D. Vann, Glen Mills, PA (US); Lu Han, Herndon, VA (US); Jonathan M. McConnachie, Annandale, NJ (US); James R. Bielenberg, Easton, PA (US); William C. Baird, Jr., Baton Rouge, LA (US); Roby Bearden, Jr., Baton Rouge, LA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 175 days.

(21) Appl. No.: 12/967,425

(22) Filed: Dec. 14, 2010

(65) Prior Publication Data

US 2011/0147273 A1 Jun. 23, 2011

Related U.S. Application Data

(60) Provisional application No. 61/284,516, filed on Dec. 18, 2009.

(51) Int. Cl.

| | |
|---|---|
| ***C10G 19/08*** | (2006.01) |
| ***C10G 19/02*** | (2006.01) |
| ***C10G 19/00*** | (2006.01) |

(52) U.S. Cl.

USPC ..... 208/235; 208/208 R; 208/226; 208/230

(58) Field of Classification Search

USPC ..... 208/208 R, 229, 177, 226, 230, 235; 585/800, 833, 853, 854

See application file for complete search history.

(56) References Cited

U.S. PATENT DOCUMENTS

| | | | |
|---|---|---|---|
| 3,051,645 | A | 8/1962 | Wilson et al. |
| 3,104,157 | A | 9/1963 | Kimberlin, Jr. et al. |
| 3,128,155 | A | 4/1964 | Mattox |
| 3,136,714 | A | 6/1964 | Gibson et al. |
| 3,164,545 | A | 1/1965 | Mattox |
| 3,354,081 | A | 11/1967 | Aldridge |
| 3,383,304 | A | 5/1968 | Mattox et al. |
| 3,438,727 | A | 4/1969 | Heredy |
| 3,442,797 | A | 5/1969 | Aldridge |

(Continued)

FOREIGN PATENT DOCUMENTS

| | | |
|---|---|---|
| JP | 55097228 | 7/1980 |
| WO | 2010039272 | 4/2010 |

OTHER PUBLICATIONS

Antos, George, Catalytic Naphtha Reforming, 2004, Marcel Dekker, Inc. pp. 11, 105-140.*

*Primary Examiner* — Walter D Griffin
*Assistant Examiner* — Derek Mueller
(74) *Attorney, Agent, or Firm* — Bruce M. Bordelon; Chad A. Guice

(57) ABSTRACT

Hydrocarbon feedstreams are desulfurized using an alkali metal reagent, optionally in the presence of hydrogen. Improved control over reaction conditions can be achieved in part by controlling the particle size of the alkali metal salt and by using multiple desulfurization reactors. After separation of the spent alkali metal reagent, the resulting product can have suitable characteristics for pipeline transport and/or further refinery processing.

15 Claims, 3 Drawing Sheets

(56) References Cited

U.S. PATENT DOCUMENTS

| | | | |
|---|---|---|---|
| 3,449,242 | A | 6/1969 | Mattox et al. |
| 3,835,033 | A | 9/1974 | Dugan et al. |
| 3,847,797 | A | 11/1974 | Pasternak et al. |
| 3,850,742 | A | 11/1974 | Dugan et al. |
| 3,852,188 | A | 12/1974 | Dugan et al. |
| 3,873,670 | A | 3/1975 | Dugan et al. |
| 3,876,527 | A | 4/1975 | Dugan et al. |
| 4,003,823 | A | 1/1977 | Baird, Jr. et al. |
| 4,003,824 | A | 1/1977 | Baird, Jr. et al. |
| 4,007,109 | A | 2/1977 | Baird, Jr. et al. |
| 4,007,111 | A | 2/1977 | Baird, Jr. |
| 4,081,522 | A | 3/1978 | Hubble et al. |
| 4,087,348 | A | 5/1978 | Baird, Jr. et al. |
| 4,119,528 | A | 10/1978 | Baird, Jr. et al. |
| 4,127,470 | A | 11/1978 | Baird, Jr. et al. |
| 4,147,611 | A | 4/1979 | Miasek et al. |
| 4,147,612 | A | 4/1979 | Miasek et al. |
| 4,437,908 | A | 3/1984 | Inoue |
| 4,545,891 | A | 10/1985 | Meyers et al. |
| 4,566,965 | A | 1/1986 | Olmstead |
| 4,686,090 | A | 8/1987 | Howell et al. |
| 4,927,524 | A | 5/1990 | Rodriguez et al. |
| 5,059,307 | A | 10/1991 | Meyers et al. |
| 5,508,018 | A | 4/1996 | Brons et al. |
| 5,626,742 | A | 5/1997 | Brons et al. |
| 5,635,056 | A | 6/1997 | Brons et al. |
| 5,695,632 | A | 12/1997 | Brons et al. |
| 5,871,637 | A | 2/1999 | Brons |
| 5,904,839 | A | 5/1999 | Brons |
| 5,935,421 | A | 8/1999 | Brons et al. |
| 5,985,764 | A | 11/1999 | Lin et al. |
| 2004/0069682 | A1 | 4/2004 | Freel et al. |
| 2004/0069686 | A1 | 4/2004 | Freel et al. |
| 2005/0230659 | A1 | 10/2005 | Hampden-Smith et al. |
| 2006/0151359 | A1 | 7/2006 | Ellis et al. |
| 2009/0065396 | A1 | 3/2009 | Kokayeff et al. |
| 2009/0152168 | A1 | 6/2009 | Siskin et al. |
| 2010/0039272 | A1 | 2/2010 | Kowalchuk |

* cited by examiner

DESULFURIZATION PROCESS USING ALKALI METAL REAGENT

This application claims the benefit of U.S. Provisional Application No. 61/284,516 filed Dec. 18, 2009.

FIELD OF THE INVENTION

The present invention relates to a process for conversion and/or desulfurization of heavy oil feedstreams.

DESCRIPTION OF RELATED ART

Heavy oils and bitumens make up an increasing percentage of available liquid hydrocarbon resources. As the demand for hydrocarbon-based fuels has increased, a corresponding need has developed for improved processes for desulfurizing heavy oil feedstreams. Processes for the conversion of the heavy portions of these feedstreams into more valuable, lighter fuel products have also taken on greater importance. These heavy oil feedstreams include, but are not limited to, whole and reduced petroleum crudes including bitumens, shale oils, coal liquids, atmospheric and vacuum residua, asphaltenes, deasphalted oils, cycle oils, FCC tower bottoms, gas oils, including atmospheric and vacuum gas oils and coker gas oils, light to heavy distillates including raw virgin distillates, hydrocrackates, hydrotreated oils, dewaxed oils, slack waxes, raffinates, and mixtures thereof.

Hydrocarbon streams boiling above 430° F. (220° C.) often contain a considerable amount of large multi-ring hydrocarbon molecules and/or a conglomerated association of large molecules containing a large portion of the sulfur, nitrogen and metals present in the hydrocarbon stream. A significant portion of the sulfur contained in these heavy oils is in the form of heteroatoms in polycyclic aromatic molecules, comprised of sulfur compounds such as dibenzothiophenes, from which the sulfur is difficult to remove.

Processing of bitumens, crude oils, or other heavy oils with large numbers of multi-ring aromatics and/or asphaltenes can pose a variety of challenges. Conventional hydroprocessing methods can be effective at improving API for a heavy oil feed, but the hydrogen consumption can be substantial. Conversion of the liquid to less valuable products, such as coke, can be another concern with conventional techniques.

SUMMARY OF THE INVENTION

The present invention relates to a process for conversion and/or desulfurization of heavy oil feedstreams.

In an embodiment, is a process for desulfurizing a hydrocarbon feedstream, comprising:

a) mixing at least a portion of a hydrocarbon feedstream having an API gravity of about 19 or less with an aqueous alkali metal salt reagent solution to form a mixed reagent stream;

b) exposing at least at portion of the mixed reagent feedstream to first effective desulfurization conditions to form a first intermediate desulfurized stream;

c) separating the first intermediate desulfurized stream to form at least a first low-boiling point fraction and a first bottoms fraction;

d) exposing at least a portion of the first bottoms fraction to second effective desulfurization conditions to form a second intermediate desulfurized stream;

e) separating the second intermediate desulfurized stream to form at least a second low-boiling point fraction and a second bottoms fraction, the second bottoms fraction including a desulfurized product and spent alkali metal salt;

f) mixing at least a portion of the second bottoms fraction with water; and g) separating the mixed water/second bottoms fraction into a desulfurized product stream and an aqueous spent alkali metal salt stream;

wherein the desulfurized product stream has a lower sulfur content by wt % than the hydrocarbon feedstream, and the desulfurized product stream has a API gravity of at least 20 and a viscosity of less than or equal to 40 centistokes at 40° C.

In a more preferred embodiment, the process is further comprised of heating the mixed reagent stream to a temperature of at least 150° C.; and removing at least at least a portion of the water from the mixed feedstream prior to step b).

In more preferred embodiments, the alkali metal salt reagent comprises an alkali metal sulfide, an alkali metal hydrogen sulfide, an alkali metal hydroxide, or a combination thereof. Even more preferred embodiments include wherein the alkali metal salt reagent comprises $K_2S$, KHS, KOH or a mixture thereof.

In a most preferred embodiment, at least a portion of at least one of the low-boiling point streams containing a naphtha fraction that is obtained after at least one of the hydrodesulfurization zones is further exposed to hydrotreating conditions thereby saturating at least 40% of the olefins in the naphtha fraction to form a hydrotreated naphtha stream. Even more preferably, at least a portion of the hydrotreated naphtha stream is reblended into the desulfurized product stream.

DETAILED DESCRIPTION OF THE INVENTION

Overview

Figure 1:
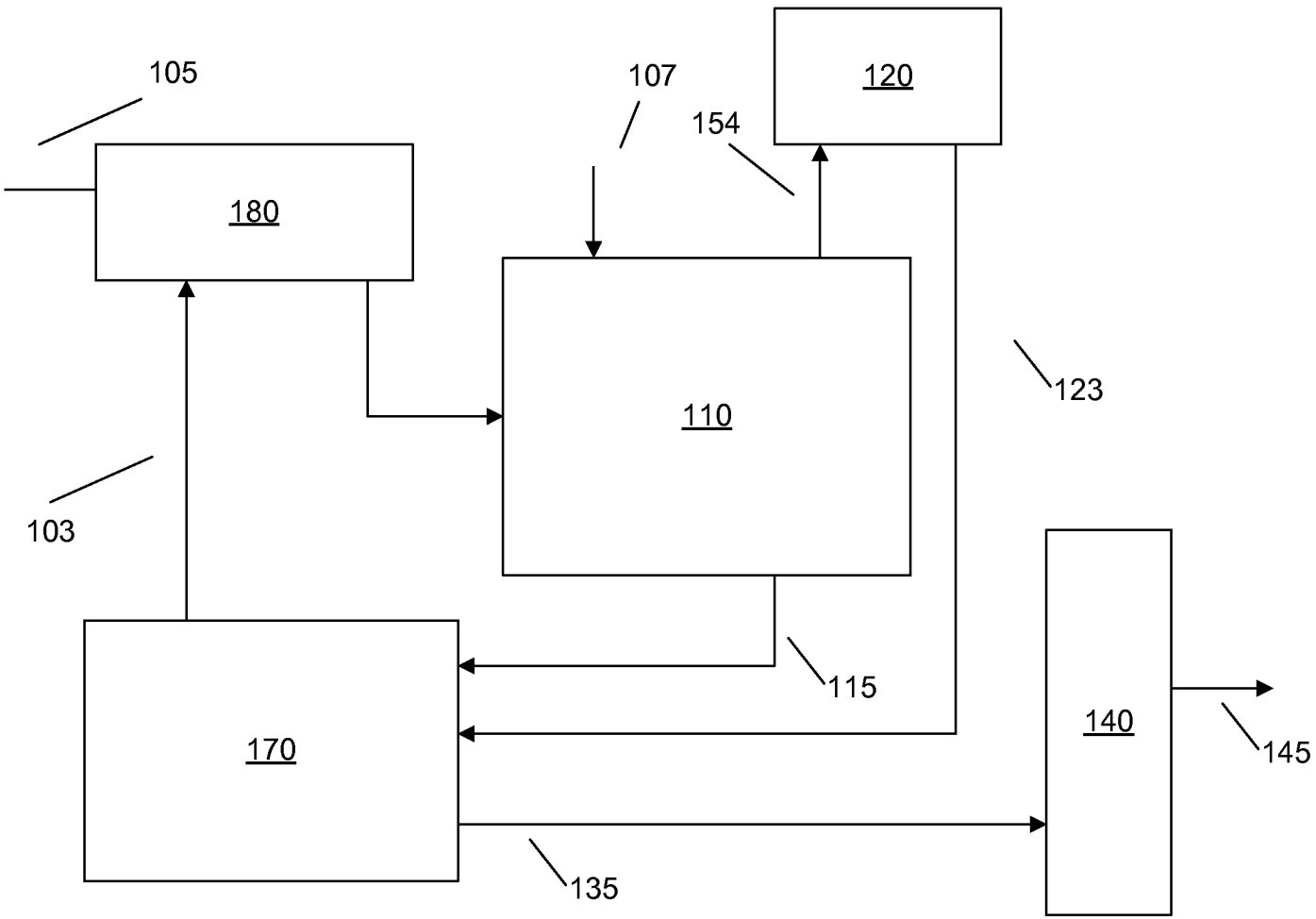
FIG. 1 schematically shows an overview of an apparatus according to an embodiment of the invention.

In various embodiments, methods are provided for desulfurization of heavy oil feeds using an alkali metal salt as a reagent. Using an alkali metal salt as a reagent can provide a number of advantages over conventional processes. Relative to thermal conversion processes, an alkali metal salt desulfurization provides for improved liquid product yields and corresponding reduction in production of coke. Relative to conventional hydroprocessing, alkali metal salt processes have a reduced hydrogen consumption. Alkali metal salt desulfurization processes can also operate at lower temperatures and/or pressures, allowing for reduced capital and/or operating costs.

In addition to the above features, an alkali metal salt reagent desulfurization process can provide for improved levels of micro carbon residue in a desulfurized feed. Processing of heavy oil feeds typically results in creation of low value, solid products such as coke. Conventionally, the amount of low value, solid product created increases with the severity of the reaction conditions. In other words, more low value, solid product can form as more sulfur is removed and/or more conversion occurs of higher boiling to lower boiling molecules. Alkali metal salt reagent desulfurization processes can mitigate this creation of coke and other solids.

The alkali metal salt desulfurization process described herein provides a variety of improvements for controlling process conditions. The particle size for the alkali metal salt particles can be adjusted by controlling the severity of the mixing step when introducing the alkali metal salt reagent into the heavy oil feed. Multiple desulfurization reactors can be employed to allow for more nuanced control over reaction conditions. Additionally, the amount of lighter fractions such as naphtha and distillate fractions blended into the desulfurized product can be controlled to improve the yield of liquid product that can be provided for pipelining and/or further processing.

Feedstocks

Various embodiments of the invention can be useful for desulfurization of "heavy oil feedstreams" or "heavy oil streams", which as used herein are equivalent. Heavy oil feedstreams or heavy oil streams are defined as any hydrocarbon-containing streams having an API gravity equal to or less than 19. Preferred heavy oil feedstreams for use in the present invention include, but are not limited to low API gravity, high sulfur, high viscosity crudes; tar sands bitumen; liquid hydrocarbon streams derived from tar sands bitumen, coal, or oil shale; as well as petrochemical refinery heavy intermediate fractions, such as atmospheric resids, vacuum resids, and other similar intermediate feedstreams and mixtures thereof containing boiling point materials above about 650° F. (343° C.). Heavy oil feedstreams as described herein may also include a blend of the hydrocarbons listed above with lighter hydrocarbon streams, such as, but not limited to, distillates, kerosene, or light naphtha diluents, and/or synthetic crudes, for control of certain properties desired for the transport or sale of the resulting hydrocarbon blend, such as, but not limited to, transport or sale as fuel oils and crude blends. In preferred embodiments of the present invention, the heavy oil feedstream contains at least 60 wt % hydrocarbon compounds, and more preferably, the heavy oil feedstream contains at least 75 wt % hydrocarbon compounds.

The sulfur content of the heavy oil feedstream can contain at least about 0.5 wt % sulfur, preferably at least about 1 wt % sulfur, and more preferably at least about 3 wt % sulfur. In other embodiments, the heavy oil feedstream can contain polycyclic sulfur heteroatom complexes which are difficult to desulfurize by conventional methods.

Alkali Metal Salt Reagent

In various embodiments, an alkali metal salt can be used as a reagent in a desulfurization process. In order to use the alkali metal salt as a reagent, the alkali metal salt can be mixed into the heavy oil feedstream as an aqueous solution. The mixture of heavy oil and aqueous alkali metal salt solution can then be partially, substantially, or completely dehydrated to produce a heavy oil feedstream containing alkali metal salt particles.

Preferably, the alkali metal can be potassium. In alternative embodiments, other alkali metals can be used, such as sodium, lithium, cesium, or rubidium. The alkali metal can be in the form of a salt, such as a sulfide or a hydroxide. Preferably, the alkali metal salt reagent can be KOH, $K_2S$, or a combination thereof. More preferably, the alkali metal salt reagent is KOH. Note that in embodiments involving a sulfide, species such as KHS that also include a hydrogen may be present, although these are believed to be not preferred due to a lower activity for sulfur removal. Mixtures of alkali metals in a reagent are also possible, such as NaKS.

In an embodiment, the alkali metal salt can be introduced into the heavy oil feed as an aqueous stream. Preferably, the aqueous stream of alkali metal salt can be a roughly or nearly saturated solution of alkali metal salt in water. The solubility of alkali metal salts in water is dependent on the type of salt. For example, KOH is soluble up to about 50 wt % KOH in an aqueous solution.

The aqueous alkali metal salt solution can be combined with the full heavy oil feed. Alternatively, the alkali metal salt solution can be mixed with a side stream of the feed. Mixing of the heavy oil and the aqueous stream can be facilitated using a static or dynamic mixer to obtain a dispersion of droplets of the aqueous phase. Preferably, a majority of the volume of the aqueous phase is included in droplets having a droplet size of less than about 1 mm, preferably less than about 0.7 mm, and more preferably less than about 0.4 mm.

After mixing of the aqueous alkali metal salt solution and the heavy oil, the water can be removed from the mixture. Removing the water from the mixture of heavy oil and alkali metal salt reagent will convert the alkali metal salt reagent from a state of droplets of salt solution suspended in the heavy oil to solid particles of the reagent in the oil. Preferably, the water can be removed from the mixture by heating the mixture. One method for removing the water is to heat the mixture to a temperature of at least about 150° C. and then separating at least a part of the water in the mixture from the hydrocarbons in a flash drum. The mixture can be heated up to temperatures of at least about 250° C., or even at least about 275° C. However, preferably, the temperature for removing the water is about 310° C. or less, or more preferably about 300° C. or less. The temperature can be selected so that the temperature is high enough to substantially remove the water while being low enough so that little or no reaction occurs between alkali metal salt reagent and the sulfur in the heavy oil.

The size of the alkali metal salt particles in the oil can be controlled in part by the severity of the mixing of the reagent solution and the heavy oil. A more severe mixing condition can lead to smaller water droplets suspended in the heavy oil. It is believed that the size of the alkali metal particles will roughly correspond to the amount of alkali metal in a droplet. Thus, increasing the severity of the mixing can lead to smaller droplets, and therefore smaller particles of alkali metal salt in the heavy oil. It is noted that the size of the alkali metal particles can also be controlled in part by modifying the concentration of the alkali metal reagent solution. However, reducing the solution concentration would mean that a greater volume of water would need to be added to the heavy oil in order to introduce a constant amount of alkali metal salt. Because the water is removed from the mixture, use of additional water can require additional heat for removal.

Note that mixing the alkali metal salt solution with a side stream of heavy oil can provide a further advantage when the water is removed. Lowering the total amount of oil present when water is removed can reduce the overall heating requirement. Preferably, when an alkali metal reagent is mixed with only a portion of a heavy oil stream, additional mixing occurs after the alkali metal reagent/heavy oil side stream mixture is added to the remainder of the heavy oil. Such additional mixing can be facilitated, for example, by including static and/or dynamic mixers in the flow path.

Alkali Metal Salt Desulfurization Reaction

After removing water, the mixture of alkali metal reagent stream and heavy oil can be introduced into a suitable reactor. Herein, the desulfurization reactor can be comprised of a vessel or even simply piping which provides sufficient contact time and conditions for a desired level of desulfurization of the hydrocarbon portion of the overall process stream. A hydrogen-containing stream may optionally be added to an alkali metal desulfurization reaction. If a hydrogen -containing stream is utilized, it is preferred that the hydrogen-containing stream contain at least 50 mol % hydrogen, more preferably at least 75 mol % hydrogen. When hydrogen is utilized in the process, it is preferred that the hydrogen partial pressure in the heavy oils desulfurization reactor be from about 100 to about 2500 psi (689 to 17,237 kPa). At these partial pressures, the hydrogen assists in the reaction process by removing at least a portion of the sulfur in the hydrocarbons via conversion to the alkali metal hydrosulfide, which may, but is not required to, go through a hydrogen sulfide, $H_2S$ intermediate. Hydrogen sulfide that is formed in the first reaction zone can also react with the alkali metal hydroxides donating some of the sulfur and forming alkali metal hydrosulfides and alkali metal sulfides thereby improving the overall sulfur removal in the process. Excess hydrogen also assists in hydrogenating the broken sulfur bonds in the hydrocarbons and increasing the hydrogen saturation of the resulting desulfurized hydrocarbon compounds.

Preferably, two or more reactors can be used as desulfurization reactors. A separator can be included after each reactor to remove contaminants, such as $H_2S$ or water vapor that forms during the reaction. Another potential advantage of using two or more reactors is that the conditions in the reactors can be controlled separately. For example, the first of two reactors can be set at more severe conditions. Based on the design of the reactor, the holding time in the first reactor can correspond to a first period of time that is less than the desired total reaction time. The partially reacted feed can then be passed to a second reactor zone at a less severe reaction condition, such as reactor at a lower temperature. By limiting the amount of time the heavy oil spends under more severe conditions, a desired level of desulfurization and/or conversion can be achieved, while reducing the amount of undesired coke production.

Suitable desulfurization conditions in a heavy oils desulfurization reactor can include temperatures from about 600° F. to about 900° F. (316° C. to 482° C.), preferably about 650° F. to about 875° F. (343° C. to 468° C.), and more preferably about 700° F. to about 850° F. (371° C. to 454° C.). Suitable reaction pressures can be from about 50 to about 3000 psi (345 to 20,684 kPa), preferably about 200 to about 2200 psi (1,379 to 15,168 kPa), and more preferably about 500 to about 1500 psi (3,447 to 10,342 kPa). In a preferred embodiment, the contact time of the heavy oils feedstream and the alkali metal hydroxide stream in the heavy oils desulfurization reactor can be about 5 to about 720 minutes, preferably about 30 to about 480 minutes, and more preferably 60 to about 240 minutes. It is noted that a suitable contact time can be dependent upon the physical and chemical characteristics of the hydrocarbon stream including the sulfur content and sulfur species of the hydrocarbon stream, the amount of sulfur to be removed, and the molar ratio of the alkali metal reagent used in the process to the sulfur present in the heavy oils feedstream.

The amount of alkali metal salt reagent mixed with the heavy oil feed can be selected based on the sulfur content of the feed. In an embodiment, the amount of alkali metal salt, on a moles of alkali metal versus moles of sulfur basis, can be at least about 1.2 times the amount of sulfur in the feed, or at least about 1.4 times, or at least about 1.5 times. Alternatively, the amount of alkali metal salt can be about 2.5 times the amount of sulfur or less, or about 2 times or less, or about 1.75 times or less. In another embodiment, the weight of the alkali metal salt particles in the hydrocarbon heavy oil feed can be at least about 1 wt %, or at least about 5 wt %, or at least about 7.5 wt %, or at least about 10 wt %, or at least about 12 wt %, or at least about 15 wt %. Alternatively, the weight of alkali metal salt particles can be about 30 wt % or less, or about 25 wt % or less, or about 20 wt % or less, or about 15 wt % or less.

In an embodiment where multiple reactors are used and where the reaction conditions are different in each reactor, the second reactor can have a temperature that is at least about 5° C. cooler than the first reactor, or at least about 10° C. cooler, or at least about 20° C. cooler. In another embodiment, the pressure in the second reactor can be at least about 100 kPa lower, or at least about 250 kPa lower. In these embodiments, the second reactor is utilized more to trim the overall desulfurization while minimizing the impacts of instable solubility due to excess cracking.

However, in different embodiments where multiple reactors are used and where the reaction conditions are different in each reactor, the second reactor can have a temperature that is at least about 5° C. higher than the first reactor, or at least about 10° C. higher, or at least about 20° C. higher. In another embodiment, the pressure in the second reactor can be at least about 100 kPa higher, or at least about 250 kPa higher. In these embodiments, the first reactor utilized for milder hydrotreating and primary product separation, and the second reactor, especially when hydrogen is added in between the two reactor stages, is utilized at higher severity on the bottoms product from the first reactor for producing a higher desulfurized final product.

The reaction time can be split between two reactors in any convenient manner. In an embodiment, at least about 20% of the reaction time occurs in the second reactor, or at least about 30%, or at least about 40%, or at least about 50%, or at least about 60%. In another embodiment, about 75% or less of the reaction time occurs in the second reactor, or about 65% or less, or about 55% or less, or about 45% or less, or about 35% or less.

In preferred embodiments, the type and/or configuration of the desulfurization reactor can be selected to facilitate proper mixing and contact between the heavy oil feedstream and the alkali metal reagent stream. Examples of preferred reactor types include slurry reactor or ebullating bed reactor designs. Additionally, static, rotary, or other types of mixing devices can be employed in the feed lines to heavy oils desulfurization reactor, and/or mixing devices can be employed in the heavy oils desulfurization reactor to improve the contact between the heavy oil feedstream and the alkali metal reagent stream. Still other devices that can be employed include heaters and/or drying drums.

In embodiments involving a desulfurization process, the sulfur content of the desulfurized hydrocarbon product stream is preferably less than about 40% of the sulfur content by weight of the heavy oils feedstream. In a more preferred embodiment of the present invention, the sulfur content of the desulfurized hydrocarbon product stream is less than about 25% of the sulfur content by weight of the heavy oils feedstream. In a most preferred embodiment of the present invention, the sulfur content of the desulfurized hydrocarbon product stream is less than about 10% of the sulfur content by wt % of the heavy oils feedstream. These parameters are based on water-free hydrocarbon streams.

Desulfurization Products

After the desulfurization, the products from the reactor(s) are passed to a separator. This initial separation is conducted at an elevated temperature, possibly up to the exit temperature of the desulfurization reactor. The separation produces a bottoms stream that includes the spent alkali metal reagent and the heavier portions of the desulfurized oil. The vapor portion from the separator includes naphtha (or a "naphtha fraction"), distillate, and $C_4$ or lighter hydrocarbons as well as $H_2$ that can be recycled. In the discussion below, $C_4$ or lighter hydrocarbons refer to hydrocarbons with 4 or fewer carbons, such as butane, butene, propane, methane, etc. Note that performing this separation at an elevated temperature reduces losses of $H_2$ due to dissolution in the bottoms fraction.

The "naphtha" or "naphtha fraction" herein is characterized by its boiling end points which are the temperatures at which 5 wt % of the stream will boil (T5 boiling point) and at which 95 wt % of the stream will boil (T95 boiling point). As utilized herein, a "naphtha" or "naphtha fraction" is any hydrocarbon-containing fraction that has a T5 boiling point of at least 25° C. (77° F.) and a T95 boiling point of less than 235° C. (455° F.).

The vapor product from the above separation can then be passed through a cooling stage to produce a cooled liquid and a cooled vapor. Preferably, the cooled liquid can be a distillate boiling range fraction, while the vapor or "low-boiling point fraction" can include naphtha and light distillate boiling range fractions as well as other low boiling hydrocarbons and hydrogen. Both the liquid and/or the vapor can optionally be subjected to a hydrotreatment step in order to saturate olefins within the fractions.

Optionally, at least part of these low-boiling point boiling fractions containing naphtha fractions is be subjected to hydrotreating conditions in order to saturate at least 40 wt %, or more preferably at least about 60% of the olefins present in the naphtha fractions. A low-boiling point fraction can be separated after the first hydrodesulfurization reaction zone, after the second hydrodesulfurization reaction zone, or both. Preferably, at least a portion of the low-boiling point fractions containing naphtha fractions produced from the first hydrodesulfurization reaction zone or the second hydrodesulfurization reaction zone, or a combination thereof are exposed to hydrotreating conditions. More preferably, at least a portion of at least one of these hydrotreating products containing naphtha fractions is reblended with the desulfurized product stream obtained from the second reaction zone.

Alternatively, the naphtha and/or light distillate fraction obtained for the separation of the products from the desulfurization reaction(s) can then be further cooled to condense the naphtha and light distillates with or without further hydrotreating. The naphtha, light distillate, and distillate fractions can be subsequently added back into the heavy oil product, if desired. These lighter fractions can be added to the heavy oil fraction prior to separation out of the alkali metal salts, or after such a separation. The $C_4$ and lower hydrocarbons and hydrogen can be subsequently processed as needed. For example, $C_4$ and lower hydrocarbons can be separated out to make fuel gas, while the excess hydrogen can be recycled.

As noted above, the bottoms fraction from the desulfurized heavy oil also includes the spent alkali metal salt reagent. The spent alkali metal reagent can be separated from the desulfurized oil. Preferably, the spent alkali metal reagent can be regenerated and/or recycled. The process for removing the spent alkali metal reagent can include adding steam and/or hot water to the desulfurized bottoms fraction. The pressure can also be reduced to a level lower than the reaction pressure but high enough to insure the presence of a water phase at the expected regeneration temperature. Reducing the pressure can also facilitate separation out of dissolved gases, such as any $H_2$, $H_2S$, or light hydrocarbons in the desulfurized heavy oil.

Either before or after separation of the spent alkali metal reagent, the desulfurized bottoms fraction can be combined with one or more of the naphtha fraction, light distillate fraction, or distillate fraction from the desulfurization. This combined desulfurized oil product can then optionally be fractionated. By controlling the amount of naphtha, light distillate, and distillate added to the heavier oil portion, and by controlling the optional fractionation, a desulfurized product can be produced with desired properties. In an embodiment, the desulfurized product can have an API of at least about 20, or at least about 21, or at least about 23. The viscosity can be about 40 cst or less at 40° C. Alternatively, the viscosity can be about 350 cst or less at a temperature of about 7.5-18.5° C.

After a desulfurization reaction, the alkali metal salt reagent can become spent. For example, a KOH or $K_2S$ reagent can react with sulfur from a feed to form spent KHS. The KHS is a lower activity species that can be regenerated to form either KOH or $K_2S$. Any suitable regeneration method can be used. For example, an ion exchange process could be used to convert KHS into KOH. Electrolysis could also be used to convert KHS into KOH.

Preferably, regeneration can be accomplished using $CO_2$ and CaO. The $CO_2$ can be used to convert KHS into $K_2CO_3$. This can be exchanged with CaO to form $CaCO_3$ and KOH.

Examples of Reaction System Configuration

FIG. 1 schematically shows an example of a reaction system for performing an embodiment of the invention. FIG. 1 illustrates a preferred embodiment of the present invention wherein an alkali metal hydroxide treatment single reactor system is utilized. It should be noted that FIG. 1 as presented herein is a simplified flow diagram, only illustrating one possible embodiment of the major processing equipment components and major process streams. It should be clear to one of skill in the art that additional equipment components and auxiliary streams may be utilized in the actual implementation of the invention as described.

In the embodiment shown in FIG. 1, a heavy oils stream 105 is mixed with an alkali metal reagent stream 103 in a pre-mixing zone 180. In pre-mixing zone 180, initial mixing of the heavy oil and alkali metal stream can occur. The mixture can also be heated to remove water from the mixed stream, leading to formation of alkali metal reagent particles within the heavy oil stream. In FIG. 1, alkali metal reagent stream is shown as being provided from alkali metal reagent separator and regenerator 170. Alternatively, some or all of the alkali metal reagent stream 103 can be provided as a fresh stream. Additional details about a possible embodiment for pre-mixing zone 180 are discussed below in connection with FIG. 1.

The dehydrated mixture of oil and alkali metal reagent particles from pre-mixing zone 180 can be combined with an optional hydrogen stream 107 in desulfurization reactor stage 110. Alternatively, the streams may be mixed prior to entering the reactor stage 110. Desulfurization reactor stage 110 can include one or more desulfurization reactors. Additional details about a possible embodiment for desulfurization reactor stage 110 are discussed below in connection with FIG. 2.

The desulfurization reactor stage 110 produces at least a stream 154 of lower boiling point compounds and a desulfurized heavy oil stream 115 that includes spent alkali metal reagent. The heavy oil stream 115 including the spent alkali metal reagent is passed to alkali metal reagent separator and regenerator 170 for removal of the alkali metal reagent. The lower boiling compounds in stream 154 can include distillate, naphtha, $C_4$ and smaller hydrocarbons, unreacted hydrogen, and contaminant gases such as $H_2S$ that formed during desulfurization. These various fractions can be separated out to allow for recovery of the hydrogen. The distillate and naphtha fractions can optionally undergo some processing, such as hydrotreatment. The zone for this further processing is shown as zone 120 in FIG. 1. Additional details about a possible embodiment for further processing of the compounds in stream 154 are discussed below in connection with FIG. 3.

After the further processing, some or all of the naphtha and/or distillate compounds can be added to the heavy oil portion. The naphtha and/or distillate compounds are shown as being added via stream 123 to separator and regenerator 170. Alternatively, stream 123 could be added to stream 115 prior to entering separator and regenerator 170, or stream 123 could be added to the output stream 135 from separator and regenerator 170. Stream 135 is then passed to optional fractionator 140, which produces a final output stream 145.

Figure 2:
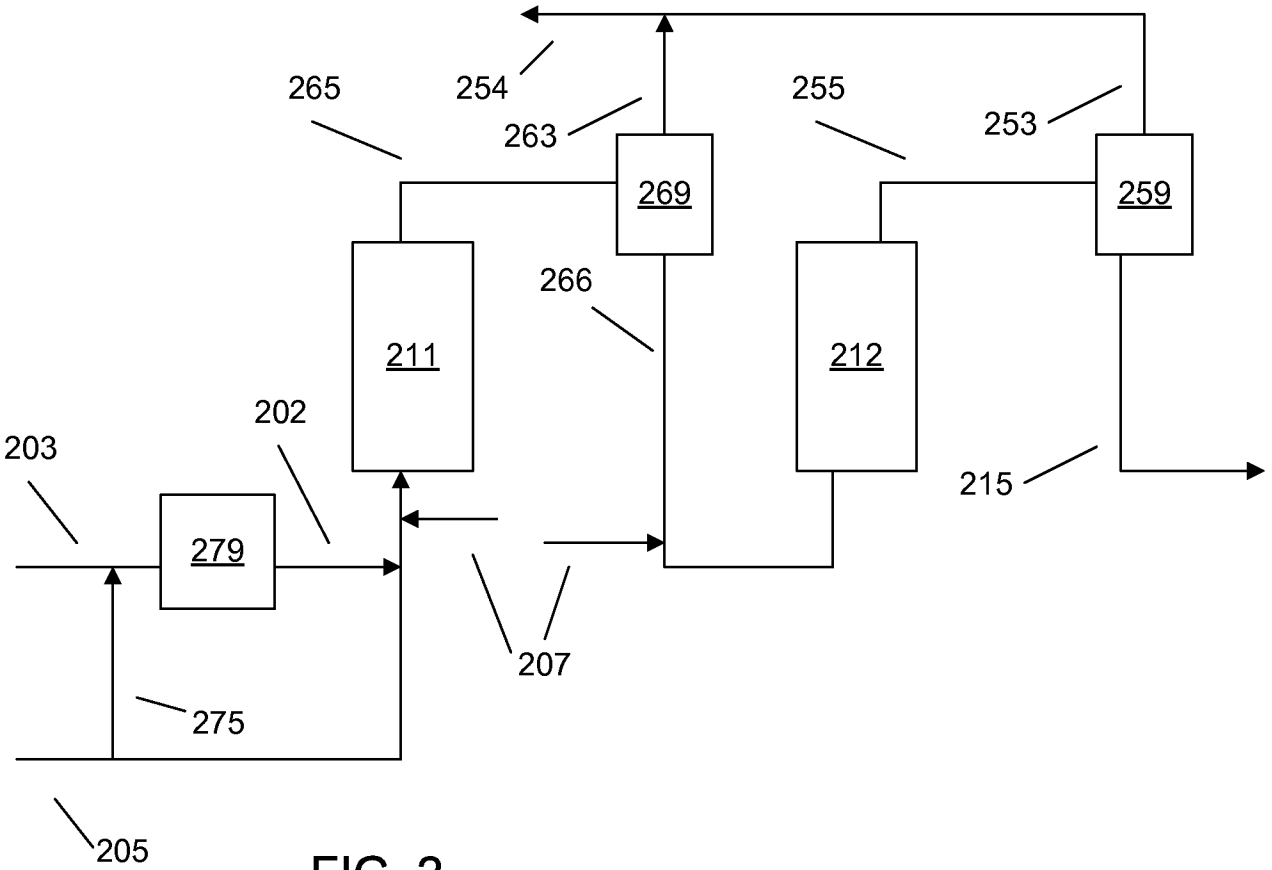
FIG. 2 schematically shows a portion of an apparatus according to an embodiment of the invention.

FIG. 2 schematically shows an example of a portion of a reaction system for desulfurizing a hydrocarbon feedstream using an alkali metal reagent. The embodiment shown in FIG. 2 is an example of a configuration for pre-mixing zone 180 and reactor zone 110 as shown in FIG. 1.

In the embodiment shown in FIG. 2, an alkali metal reagent stream 203 is combined with a side feed stream 275. FIG. 2 shows feed stream 275 as a side stream of the main hydrocarbon feed 205. Alternatively, main feed 205 could be combined with the alkali metal reagent stream 203. The combination of side feed stream 275 and alkali metal reagent stream 203 is passed into heating vessel 279. Optionally, static or dynamic mixers (not shown) can be included either in the conduit leading to heating vessel 279, or in the chamber itself. Preferably, the feed and alkali metal reagent stream can be mixed sufficiently to provide a desired droplet size, so as to provide a desired alkali metal reagent particle size after drying. The mixed feed is heated in vessel 279 to remove water from the feed, leading to formation of alkali metal reagent particles. Preferably, substantially all water is removed from the mixture of hydrocarbon feed and alkali metal reagent. After removing water, the mixed hydrocarbon and alkali metal reagent stream 202 is combined with the remainder of the hydrocarbon feed 205. Optionally, additional static or dynamic mixers (not shown) can be used to facilitate mixing of the hydrocarbon feed and the alkali metal reagent.

The mixture of feed and alkali metal reagent is then combined with an optional hydrogen stream 207 and passed into a first desulfurization reactor 211. Note that optional hydrogen stream 207 can be added into desulfurization reactor 211, as opposed to combining with the feed prior to entering the reactor. Reactor 211 is shown as a separate structure in FIG. 2, but in other embodiments reactor 211 can be any convenient structure or vessel that provides a sufficient holding time for desulfurization. For example, in some embodiments reactor 211 can be a pipe or other conduit. In the embodiment shown in FIG. 2, the effluent 265 from reactor 211 is passed to a separator 269. Preferably, separator 269 is operated at a temperature and pressure so that the amount of cooling and/or pressure reduction between reactor 211 and separator 269 is reduced or minimized. Separator 269 produces a lower boiling gas phase stream 263 that can include naphtha, distillate, unreacted hydrogen, and other molecules that are in a gas phase at the separation and/or desulfurization reaction temperature. The lower boiling stream 263 can undergo further processing, along with recovery of the naphtha and/or distillate portions for inclusion with a final product. Separator 269 also produces a bottoms stream 266 that includes a partially desulfurized liquid hydrocarbon product and a mixture of fresh and spent alkali metal reagent. This stream can be combined with another optional hydrogen stream 207 before entering second desulfurization reactor 212. The effluent 255 from second desulfurization reactor 212 can again be separated in separator 259 into a gas phase stream 253 and a bottoms stream 215. The bottoms stream includes the liquid desulfurized product and the spent alkali metal catalyst. In FIG. 1, the stream 215 was sent to a process for separation and regeneration of the spent alkali metal catalyst. The gas phase stream 253 can be combined with the lower boiling gas phase stream 263 to form a stream 254 for further processing.

Figure 3:
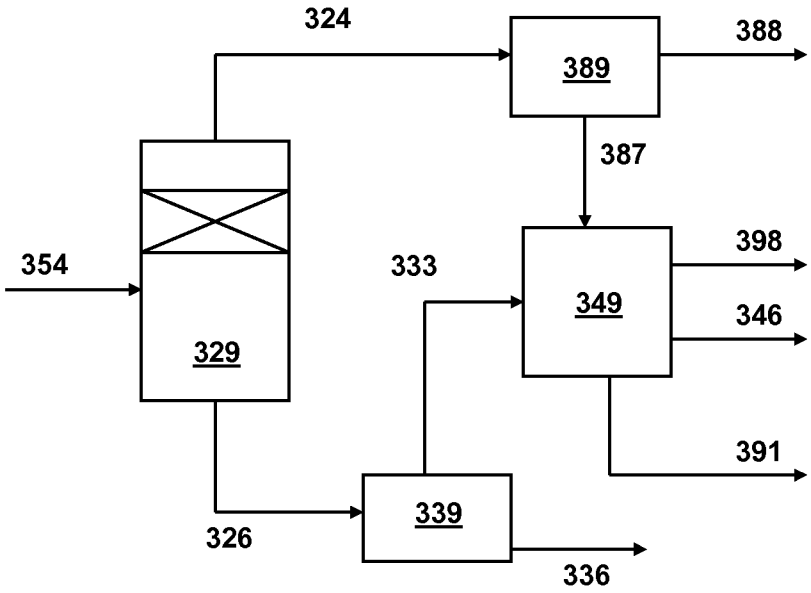
FIG. 3 schematically shows a portion of an apparatus according to an embodiment of the invention.

FIG. 3 schematically shows an example of a portion of a reaction system for separation and other further processing of lower boiling compounds from an alkali metal desulfurization reaction. The embodiment shown in FIG. 3 is an example of a configuration for a further processing zone 120 as shown in FIG. 1.

In the embodiment shown in FIG. 3, stream 354 is passed into a separator and hydrotreater 329. Stream 354 can include a variety of compounds that are gas phase at or near the temperature of the desulfurization reaction. Stream 354 can include naphtha and distillate boiling range compounds, unreacted $H_2$, contaminants such as $H_2S$, and other low boiling hydrocarbon compounds such as $C_4$ or lighter hydrocarbons.

Separator 329 can be used to separate out a stream 326 of distillate boiling range compounds from a stream 324 of light distillate, naphtha, and other lighter compounds. Stream 324 can also contain water vapor. As shown in FIG. 3, prior to forming stream 324, the light distillate, naphtha, and other lighter compounds are hydrotreated in a hydrotreating zone in separator 329. This can be accomplished, for example, by exposing the light distillate, naphtha, and other lighter compounds to a hydrotreating catalyst in the presence of the unreacted hydrogen present in stream 354. The hydrotreatment conditions can be sufficient to saturate at least about 20% of the olefins present in the fraction that will form stream 324, or at least about 40% of the olefins, or at least about 60% of the olefins. In an embodiment, the hydrotreating conditions can include a pressure of from about 60 psig (414 kPa) to about 800 psig (5516 kPa), a hydrogen feed rate from about 500 standard cubic feet per barrel (scf/b) (84.2 $m^3/m^3$) to about 6000 scf/b (1011 $m^3/m^3$), and a liquid hourly space velocity from about of about 0.5 $hr^{-1}$ to about 15 $hr^{-1}$, and a temperature of from about 425° F. to about 600° F.

Hydrotreated stream 324 can then be sent to a medium temperature and/or pressure separator 389, to separate out a stream 388 of $H_2S$, unreacted $H_2$, and $C_4$ or lighter hydrocarbons. Separator 389 also produces a stream of naphtha and/or light distillate boiling range compounds 387 that may also include water. Stream 387 can be forwarded to a separation stage 349 that will be described further below.

Optionally, stream 326 from separator 329 can also be hydrotreated (not shown), such as to saturate olefins within stream 326. Stream 326 can then undergo a further separation in a low pressure and/or low temperature separator 339. The liquid output 336 from separator 339 can be added to the desulfurized oil product. Gas phase output 333 from separator 339 can be sent to an additional cold separation stage 349. Separation stage 349 can produce several streams, including a naphtha and/or light distillate boiling range stream 346, a sour water stream 391, and another stream 398 of $H_2S$, unreacted $H_2$, and $C_4$ or lighter hydrocarbons.

Additional Embodiments

In a first embodiment, a process for desulfurizing a hydrocarbon stream is provided. The process includes mixing a feedstream having an API gravity of about 19 or less with an aqueous alkali metal salt reagent solution. The mixed feedstream and alkali metal salt reagent are exposed to first effective desulfurization conditions to form at least a first naphtha fraction and a first bottoms fraction. The first bottoms fraction is exposed to second effective desulfurization conditions to form at least a second naphtha fraction and a second bottoms fraction, the second bottoms fraction including an at least partially desulfurized product and spent alkali metal salt. The combined first naphtha fraction and second naphtha fraction are hydrotreated under conditions effective to saturate at least 40% of the olefins in the combined naphtha fractions. The at least partially desulfurized product is then separated from the spent alkali metal salt. At least a portion of the hydrotreated combined naphtha fractions are blended with the partially desulfurized product, the blended product having an API of at least 20 and a viscosity of 40 cst or less at 40° C.

In a second embodiment, a method according to the first embodiment is provided, further comprising removing water from the mixed feedstream to form alkali metal salt particles.

In a third embodiment, a method according to the first or second embodiments is provided, wherein mixing the feedstream with an aqueous alkali metal salt reagent stream comprises mixing the streams sufficiently to produce a dispersed aqueous phase, a majority of a volume of the dispersed aqueous phase being in the form of droplets having a size of about 1 mm or less.

In a fourth embodiment, a process for desulfurizing a hydrocarbon stream is provided. The process includes splitting a feedstream having an API gravity of about 19 or less to form a first stream and a side stream. The side stream is mixed with an aqueous alkali metal salt reagent solution. Water is removed from the mixed stream to form alkali metal salt particles. The mixed stream is then combined with the first stream. The combined stream is exposed to effective desulfurization conditions to form an effluent including an at least partially desulfurized product and spent alkali metal salt. The spent alkali metal salt is then separated from the partially desulfurized product.

In a fifth embodiment, a process for desulfurizing a hydrocarbon stream is provided. The process includes splitting a feedstream having an API gravity of about 19 or less to form a first stream and a side stream. The side stream is mixed with an aqueous alkali metal salt reagent solution. Water is removed from the mixed stream to form alkali metal salt particles. The mixed stream is then combined with the first stream. The combined feedstream is exposed to first effective desulfurization conditions to form at least a first naphtha fraction and a first bottoms fraction. The first bottoms fraction is exposed to second effective desulfurization conditions to form at least a second naphtha fraction and a second bottoms fraction, the second bottoms fraction including an at least partially desulfurized product and spent alkali metal salt. The combined first naphtha fraction and second naphtha fraction are hydrotreated under conditions effective to saturate at least 40% of the olefins in the combined naphtha fractions. The at least partially desulfurized product is separated from the spent alkali metal salt. At least a portion of the hydrotreated combined naphtha fractions are then blended with the partially desulfurized product, the blended product having an API of at least 20 and a viscosity of 40 cst or less at 40° C.

In a sixth embodiment, a process according to the fourth or fifth embodiments is provided, wherein mixing the side stream with an aqueous alkali metal salt reagent stream comprises mixing the streams sufficiently to produce a dispersed aqueous phase, a majority of a volume of the dispersed aqueous phase being in the form of droplets having a size of about 1 mm or less.

In a seventh embodiment, a process according to any of the above embodiments is provided, wherein the alkali metal salt reagent comprises an alkali metal sulfide, an alkali metal hydrogen sulfide, an alkali metal hydroxide, or a combination thereof.

In an eighth embodiment, a process according the seventh embodiment is provided, wherein the alkali metal salt reagent comprises $K_2S$, KHS, KOH or a mixture thereof.

In an ninth embodiment, a process according to any of the above embodiments is provided, wherein the spent alkali metal salt comprises $K_2S$, KHS, KNaS, or a mixture thereof.

In a tenth embodiment, a process according to any of the above embodiments is provided, wherein the reaction conditions in the first reaction zone are from about 50 to about 3000 psi (345 to 20,684 kPa), and from about 600° F. to about 900° F. (316° C. to 482° C.).

In a eleventh embodiment, a process according to any of the above claims is provided, wherein the feedstream is a heavy oil feedstream having a sulfur content of at least about 3 wt %.

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

What is claimed is:

1. A process for desulfurizing a hydrocarbon feedstream, comprising:

a) mixing at least a portion of a hydrocarbon feedstream having an API gravity of about 19 or less with an aqueous alkali metal salt reagent solution to form a mixed reagent stream;

b) heating the mixed reagent stream to a temperature of at least 150° C.;

c) removing at least a portion of the water from the mixed feedstream;

d) exposing, after removing the at least a portion of the water, at least a portion of the mixed reagent feedstream to first effective desulfurization conditions to form a first intermediate desulfurized stream;

e) separating the first intermediate desulfurized stream to form at least a first low-boiling point fraction and a first bottoms fraction wherein the first low-boiling point fraction is comprised of naphtha, distillate, or a combination thereof;

f) adding at least a portion of the first low-boiling point fraction to an alkali metal salt regeneration process;

g) exposing at least a portion of the first bottoms fraction to second effective desulfurization conditions to form a second intermediate desulfurized stream;

h) separating the second intermediate desulfurized stream to form at least a second low-boiling point fraction and a second bottoms fraction, the second bottoms fraction including a desulfurized product and spent alkali metal salt;

i) mixing at least a portion of the second bottoms fraction with water; and i) separating the mixed water/second bottoms fraction into a desulfurized product stream and an aqueous spent alkali metal salt stream;

wherein the desulfurized product stream has a lower sulfur content by wt % than the hydrocarbon feedstream, and the desulfurized product stream has a API gravity of at least 20 and a viscosity of less than or equal to 40 centistokes at 40° C., and the alkali metal salt reagent solution comprises $K_2$ S, KHS, KOH, or a mixture thereof and at least a portion of the aqueous spent alkali metal salt stream comprises $K_2$ S, KHS, KNaS, or a mixture thereof which is sent to the alkali metal salt regeneration process wherein at least a portion of the $K_2$ S, KHS, or KNaS in the mixture is converted to KOH.

2. The process of claim 1, wherein the mixing in step a) comprises mixing the streams sufficiently to produce a dispersed aqueous phase, a majority of a volume of the dispersed aqueous phase being in the form of droplets having a size of about 1 mm or less.

3. The process of claim 1, wherein mixing the hydrocarbon feedstream with the aqueous alkali metal salt reagent solution comprises mixing the streams sufficiently to produce a dispersed aqueous phase, a majority of a volume of the dispersed aqueous phase being in the form of droplets having a size of about 1 mm or less.

4. The process of claim 1, wherein the first effective desulfurization conditions are from about 50 to about 3000 psi (345 to 20,684 kPa), and from about 600° F. to about 900° F. (316° C. to 482° C.).

5. The process of claim 1, wherein the first low-boiling point fraction is comprised of a first naphtha fraction, wherein the first naphtha fraction has a T5 boiling point greater than 25° C. (77° F.) and a T95 boiling point less than 235° C. (455° F.); and wherein at least a portion of this first naphtha fraction is exposed to hydrotreating conditions thereby saturating at least 40% of the olefins in the first naphtha fraction to form a first hydrotreated naphtha stream.

6. The process of claim 5, wherein the second low-boiling point fraction is comprised of a second naphtha fraction, wherein the second naphtha fraction has a T5 boiling point greater than 25° C. (77° F.) and a T95 boiling point less than 235° C. (455° F.); and wherein at least a portion of this second naphtha fraction is exposed to hydrotreating conditions thereby saturating at least 40% of the olefins in the second naphtha fraction to form a second hydrotreated naphtha stream.

7. The process of claim 6, wherein at least a portion of the first naphtha fraction and at least a portion of the second naphtha fraction are combined to form a mixed naphtha fraction prior to being exposed to the hydrotreating conditions thereby saturating at least 40% of the olefins in the mixed naphtha fraction to form a mixed hydrotreated naphtha stream.

8. The process of claim 1, wherein at least a portion of the hydrocarbon feedstream that was not mixed with the aqueous alkali metal salt reagent solution in step a) is combined with the mixed reagent stream before exposing the combined stream to first effective desulfurization conditions in step d).

9. The process of claim 5, wherein at least a portion of the first hydrotreated naphtha stream is combined with the desulfurized product stream.

10. The process of claim 6, wherein at least a portion of the second hydrotreated naphtha stream is combined with the desulfurized product stream.

11. The process of claim 7, wherein at least a portion of the mixed hydrotreated naphtha stream is combined with the desulfurized product stream.

12. The process of claim 1, wherein a hydrogen-containing stream, comprised of at least 75 mol % hydrogen is added to the mixed reagent feedstream before exposing the mixture to the first effective desulfurization conditions in step d).

13. The process of claim 1, wherein the alkali metal salt regeneration process utilizes CaO to convert at least a portion of the $K_2$ S, KHS, or KNaS in the mixture to KOH.

14. The process of claim 1, wherein the amount of alkali metal salt (on an alkali metal molar basis) in the aqueous alkali metal salt reagent solution is at least 1.2 times the amount of sulfur (on a sulfur molar basis) of the hydrocarbon feedstream.

15. The process of claim 1, wherein the hydrocarbon feedstream is a heavy oil feedstream having a sulfur content of at least about 3 wt %.

* * * * *